US010566751B1

(12) United States Patent
Chen et al.

(10) Patent No.: US 10,566,751 B1
(45) Date of Patent: Feb. 18, 2020

(54) LAMP SOCKET

(71) Applicant: Xiamen Ghgm Electric Co., Ltd., Xiamen (CN)

(72) Inventors: Bingshui Chen, Xiamen (CN); Baohua Huang, Xiamen (CN); Zhihuan Li, Xiamen (CN); Yonglong Li, Xiamen (CN)

(73) Assignee: XIAMEN GHGM ELECTRIC CO., LTD., Xiamen (CN)

( * ) Notice: Subject to any disclaimer, the term of this patent is extended or adjusted under 35 U.S.C. 154(b) by 0 days.

(21) Appl. No.: 16/417,648

(22) Filed: May 21, 2019

(30) Foreign Application Priority Data

Apr. 18, 2019 (CN) ..... 2019 1 0311782

(51) Int. Cl.
*H01R 33/22* (2006.01)
*F21V 23/06* (2006.01)

(52) U.S. Cl.
CPC ..... *H01R 33/22* (2013.01); *F21V 23/06* (2013.01)

(58) Field of Classification Search
CPC ..... H01R 33/22; H01J 5/60
USPC ..... 439/615; 313/318.04
See application file for complete search history.

(56) References Cited

U.S. PATENT DOCUMENTS 5,521,460 A * 5/1996 Zhu ..... H01J 5/60 24/563
6,346,767 B1 * 2/2002 Swadel ..... H01J 5/48 313/318.01
6,469,427 B1 * 10/2002 Itaya ..... H01J 5/60 313/25
6,488,538 B1 * 12/2002 Matsuba ..... H01J 5/54 439/615
6,791,250 B2 * 9/2004 Jurkovic ..... H01J 5/50 313/318.04
9,033,742 B2 * 5/2015 Urano ..... H01R 12/721 313/318.04
9,035,543 B2 * 5/2015 Fan ..... F21V 23/06 313/318.01
9,310,061 B2 * 4/2016 Mostoller ..... F21K 9/00
9,634,414 B1 * 4/2017 Chen ..... H01R 13/113
9,673,544 B1 * 6/2017 Chen ..... H01R 12/718
9,702,530 B2 * 7/2017 Gielen ..... F21V 17/005
9,709,256 B2 * 7/2017 Chen ..... F21V 23/06
9,897,264 B1 * 2/2018 Chen ..... F21K 9/235
9,966,718 B2 * 5/2018 Chen ..... H01R 33/22
2009/0295268 A1 * 12/2009 Peng ..... H01J 5/62 313/318.04

* cited by examiner

*Primary Examiner* — Neil Abrams

(57) ABSTRACT

The lamp socket includes a connecting seat, a lamp cap, a first conductive wire and a second conductive wire. The connecting seat has a first passage provided therein, a first threaded section for thread connection with a lamp and an accommodating portion or hole in the first threaded section. The lamp cap is detachably provided at the connecting seat, and has a first conductive region and a second conductive region, the second conductive region having a second threaded section adapted to the first threaded section. A thread gap is formed between the first threaded section and the second threaded section. A limiting portion which may be formed as a mass enlargement at the end of the first wire cooperates with the accommodating portion or hole to prevent pull out of the wire from the thread group.

8 Claims, 5 Drawing Sheets

LAMP SOCKET

CROSS REFERENCE TO RELATED APPLICATION

This application claims the priority benefit of Chinese Patent Application Nos. 201910311782.3, filed on Apr. 18, 2019, which is hereby incorporated by reference in its entirety.

TECHNICAL FIELD

This disclosure relates to the technical field of lamp socket, and more particularly to a lamp socket.

BACKGROUND ART

A lamp socket is a device used to secure a lamp and connect the lamp contacts to a power source.

In prior art, the lamp socket has a lamp cap, a connecting seat, and two wires composed of conductive fibers. The lamp cap is connected with the connecting seat through a threaded connection, where one wire is connected to the lamp cap, and the other wire is provided between the connecting seat and a spiral surface of the lamp cap after insulating leather is removed from its end. In actual use, the wire sandwiched between the connecting seat and the lamp cap often cannot be firmly stuck and is easily pulled out, which poses safety hazards when used.

In view of this, the inventors propose the present application after studying the prior art.

SUMMARY

The present disclosure provides a lamp socket, which is intended to improve the lamp socket of the prior art, and solve the problem that the wire cannot be firmly fixed and can be easily pulled out.

In order to solve the technical problem stated above, the present disclosure provides a lamp socket, comprising: a connecting seat having a first passage provided therein, the connecting seat having a first threaded section for threaded engagement with a lamp and an accommodating portion provided in the first threaded section; a lamp cap detachably provided at the connecting seat, the lamp cap having a first conductive region and a second conductive region, the second conductive region being provided with a second threaded section adapted to the first threaded section, a thread gap being formed between the first threaded section and the second threaded section; a first conductive wire passing through the first passage and electrically connected to the first conductive region; and a second conductive wire having an end provided with a conductive section, the conductive section being provided with a limiting portion having a radial dimension greater than the thread gap. The second conductive wire passes through the first passage, the conductive section passes through the thread gap, and the limiting portion is provided in the accommodating portion.

In some embodiments, the accommodating portion is a first through hole that penetrates the first threaded section and communicates with the first passage.

In some embodiments, the accommodating portion has a blind hole provided in the threaded section.

In some embodiments, the limiting portion is a bulk conductor or a spherical conductor on the conductive section.

In some embodiments, the limiting portion is made of tin.

In some embodiments, an upper edge of the connecting seat has a first groove adapted to the second conductive wire, the first groove being disposed for limiting the second conductive wire.

In some embodiments, the first conductive wire is a positive wire and the second conductive wire is a negative wire.

The beneficial effects of embodiments provided in the disclosure are as follows.

When the lamp socket of the present disclosure is in use, the wire sandwiched between the connecting seat and the lamp cap cannot be easily pulled out, which enhances the stability of the lamp socket and avoids the occurrence of safety hazards. Specifically, the first conductive wire passes through the connecting seat and is electrically connected to the first conductive region of the lamp cap. The second conductive wire passes through the connecting seat, the conductive section is bent outwardly and passes through the thread gap between the first threaded section and the second threaded section, and the limiting portion disposed on the conductive section is accommodated in the accommodating portion. Since the radial dimension of the limiting portion is larger than the thread gap, the limiting portion can be firmly fixed in the accommodating portion to prevent the conductive section from being directly pulled out from the thread gap when the second conductive wire is pulled. In addition, since the limiting portion is disposed in the accommodating portion, the conductive section is extended from the accommodating portion to the thread gap at an angle, which is nearly 90°. Therefore, the frictional force between the conductive section and the edge of the accommodating portion is greatly enhanced, and thus it is further ensured that the limiting portion is firmly fixed in the accommodating portion.

However, in the prior art, the conductive section does not have a limiting portion, and the connecting seat does not have an accommodating portion. Since the conductive section is often composed of a plurality of conductive fibers, they are likely to be bifurcated during use, which greatly reduces the friction force between the conductive section and the first and second threaded sections, which would further weaken the disposition of the conductive section in the thread gap. Therefore, compared with the prior art, the lamp cap of the present disclosure can greatly enhance the stable arrangement of the conductive section in the thread gap, which can greatly enhance the stability of the lamp socket and avoid the occurrence of safety hazards.

BRIEF DESCRIPTION OF THE DRAWINGS

The embodiments of the disclosure will become apparent and more readily appreciated from the following description of the embodiments, taken in conjunction with the accompanying drawings. It should be understood that the following drawings merely show certain embodiments of the disclosure and therefore should not be considered as limit to the scope of the disclosure. For those skilled in the art, other related drawings may also be obtained based on these drawings without any creative work. In the accompanying drawings.

DETAILED DESCRIPTION

Figure 1:
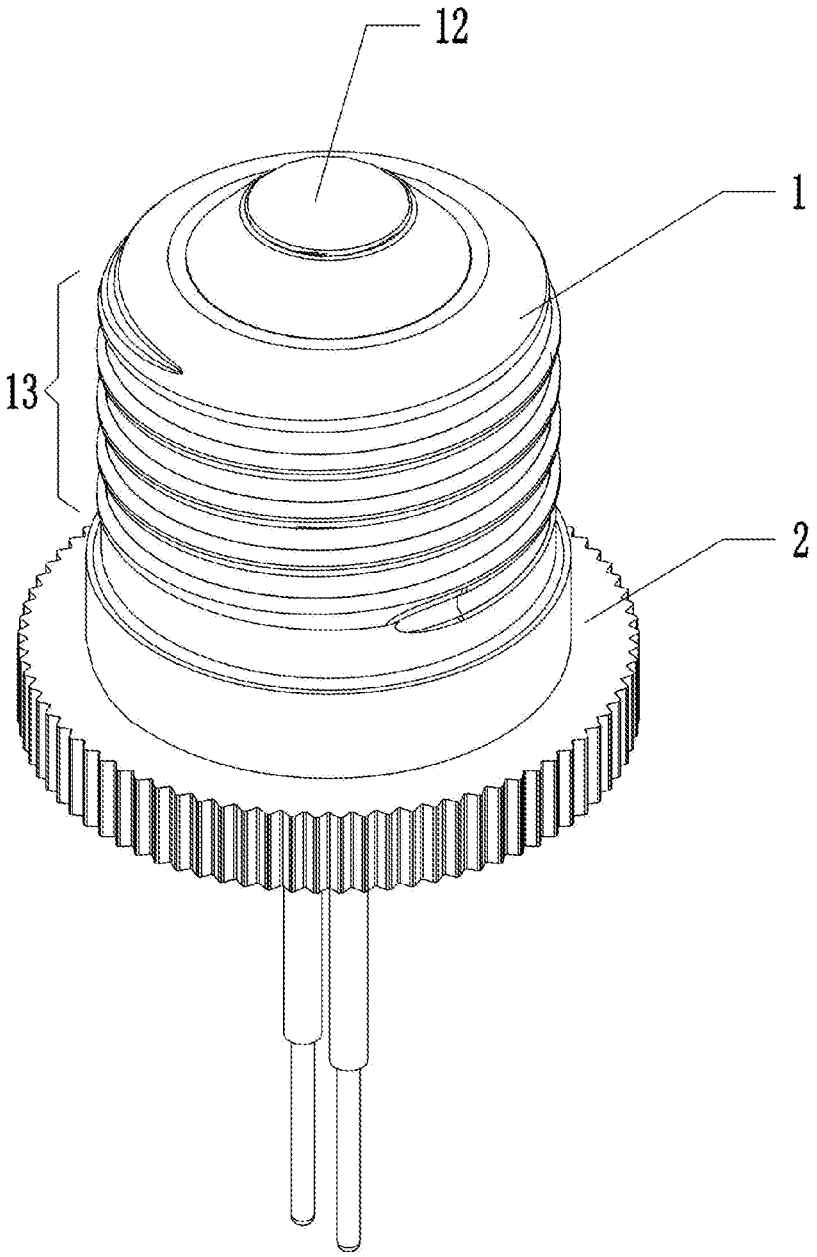
FIG. 1 is an isometric view of a lamp socket according to an embodiment of the present disclosure.

The technical solutions in the embodiments of the present disclosure will be clearly and completely described in conjunction with the drawings of the embodiments of the present disclosure. Apparently, what is described are some but not all of the embodiments of the present disclosure. All other embodiments obtained by a person of ordinary skill in the art based on the embodiments of the present disclosure without creative efforts are within the scope of the present disclosure. Therefore, the following detailed description of the embodiments of the present disclosure are not intended to limit the scope of the present disclosure, but to explain the selected embodiments of the present disclosure. All other embodiments obtained by a person of ordinary skill in the art based on the embodiments of the present disclosure without creative efforts are within the scope of the present disclosure.

In the description of the present disclosure, it is to be understood that the orientational or positional relationships indicated by the terms "center", "longitudinal", "transversal", "length", "width", "thickness", "upper", "lower", "front", "rear", "left", "right", "vertical", "horizontal", "top", "bottom", "inside", "outside", "clockwise", "counterclockwise", etc. are based on the orientation or positional relationship shown in the drawings, are merely for the convenience of describing the present disclosure and simplifying the description, and do not indicate or imply that the device or component referred to must have a specific orientation or be constructed and operated in a specific orientation. Therefore, it should not be construed as limiting the present disclosure.

Moreover, the terms "first" and "second" are used for descriptive purposes only and are not to be construed as indicating or implying a relative importance or implicitly indicating the number of technical features indicated. Thus, features defining "first" and "second" may include one or more of the features either explicitly or implicitly. In the description of the present disclosure, the meaning of "a plurality" is two or more unless specifically defined otherwise.

In the present disclosure, the terms "install", "connected", "connect", "fix" and the like shall be understood broadly. For example, the connection may be a fixed connection or a detachable connection or integration; may be a mechanical connection or an electrical connection; may be directly connected, may be indirectly connected through an intermediate medium, or may be an internal communication of two elements or the interaction of two elements, unless explicitly stated and defined otherwise. For those skilled in the art, the specific meanings of the above terms in the present disclosure can be understood based on specific situations.

In the present disclosure, when a first feature is described to be "on" or "under" a second feature, situations may include direct contact of the first and second features, and may also include indirect contact of first and second features through another feature therebetween, unless otherwise specifically defined. Moreover, when a first feature is described to be "over", "above" and "on" the second feature, situations include that the first feature is directly above the second feature, or that the first feature is merely located higher than the second feature. When a first feature is described to be "under", "below" and "down" the second feature, situations include that the first feature is directly or below the second feature, or that the first feature is merely located lower than the second feature.

The present disclosure will be further described in detail below with reference to the accompanying drawings and specific embodiments.

As shown in FIG. 1 to FIG. 5, an embodiment of a lamp socket includes a connecting seat 2 having a first passage 9 provided therein. The connecting seat 2 has a first threaded section 8 for a threaded connection with a lamp and an accommodating portion 7 provided in the first threaded section 8. A lamp cap 1 is detachably provided at the connecting seat 2. The lamp cap 1 has a first conductive region 12 and a second conductive region 13. The second conductive region 13 has a second threaded section 5 adapted to the first threaded section 8. A thread gap is formed between the first threaded section 8 and the second threaded section 5. A first conductive wire 3 passing through the first passage 9 and electrically connected to the first conductive region 12. A second conductive wire 4 has an end provided with a conductive section 11. The conductive section 11 is provided with a limiting portion 10 having a radial dimension greater than the thread gap.

The second conductive wire 4 is passed through the first passage 9. The conductive section 11 passes through the thread gap, and the limiting portion 10 is provided in the accommodating portion 7. In one embodiment, the first conductive wire 3 is a positive wire and the second conductive wire 4 is a negative wire. The first conductive region 12 is a positive conductive region, and the second conductive region 13 is a negative conductive region. The first conductive region 12 and the second conductive region 13 are isolated from each other.

Figure 3:
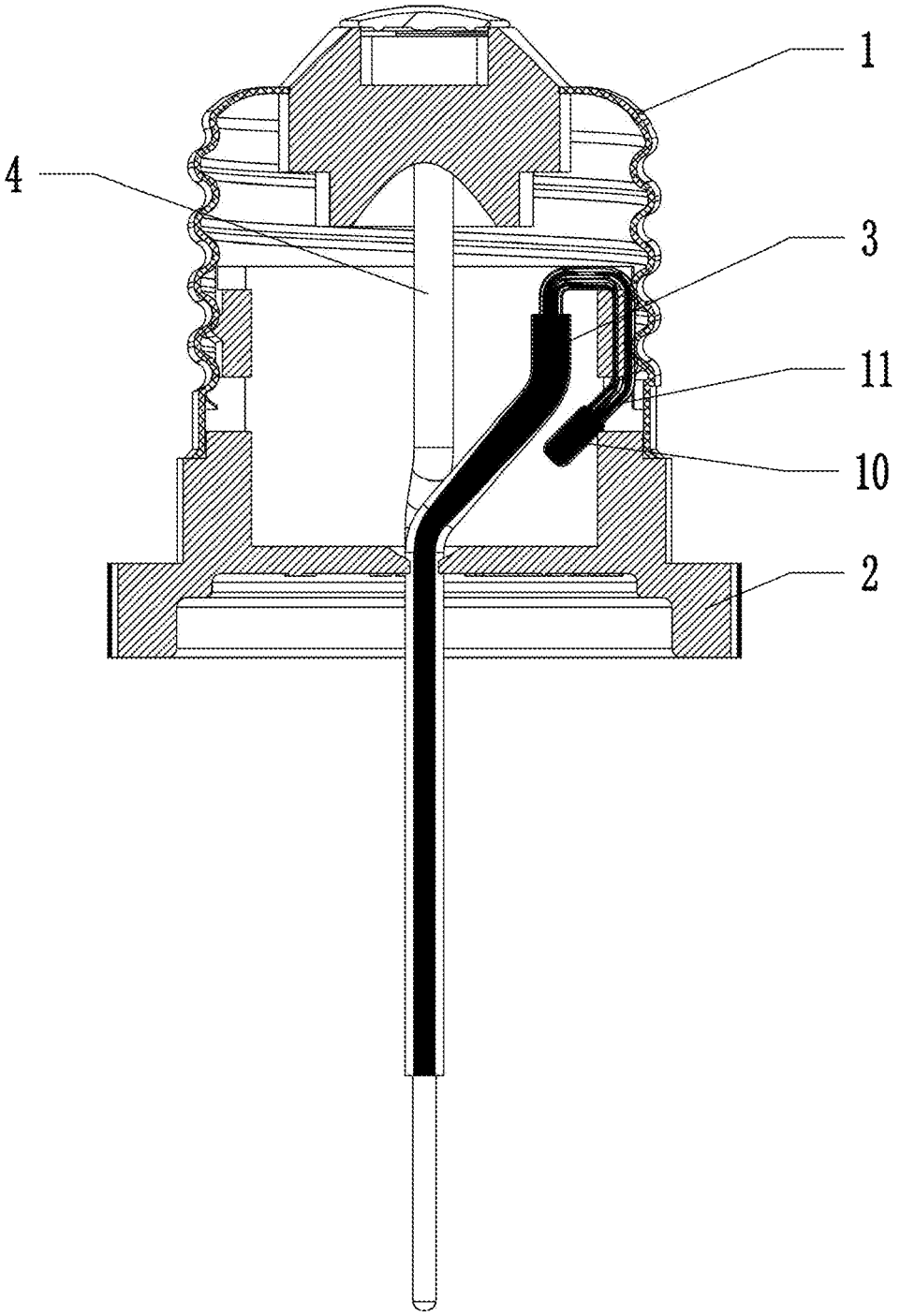
FIG. 3 is a sectional view of a lamp socket according to an embodiment of the present disclosure.
Figure 4:
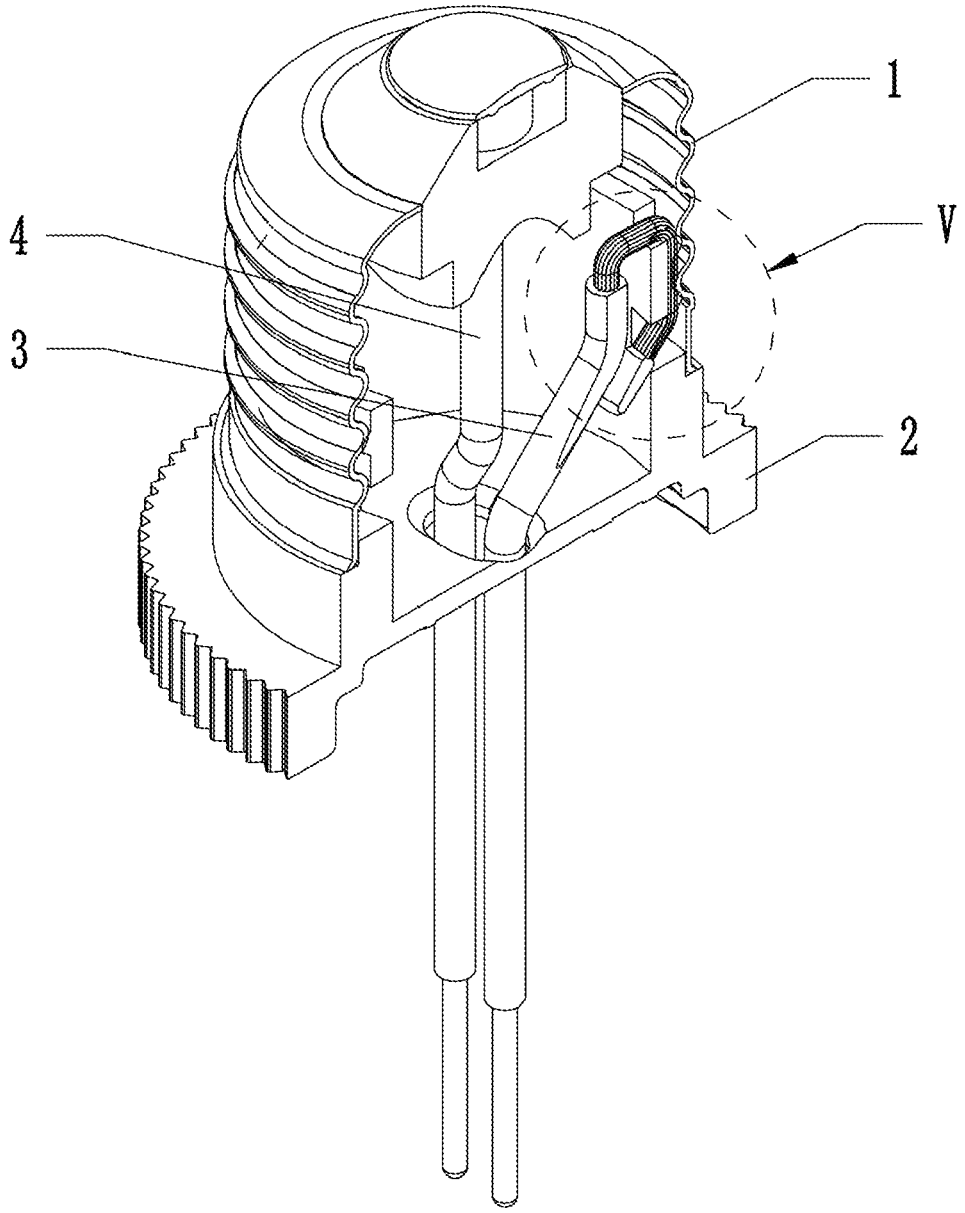
FIG. 4 is an isometric sectional view of a lamp socket according to an embodiment of the present disclosure.

As shown in FIG. 3 and FIG. 4, the first conductive wire 3 passes through the connecting seat 2 and is electrically connected to the first conductive region 12 of the lamp cap 1. The second conductive wire passes through the connecting seat 2, the conductive section 11 is bent outwardly and passes through the thread gap between the first threaded section 8 and the second threaded section 5, and the limiting portion 10 disposed on the conductive section 11 is accommodated in the accommodating portion 7. Since the radial dimension of the limiting portion 10 is larger than the thread gap, the limiting portion 10 can be firmly stuck in the accommodating portion 7 to prevent the conductive section 11 from being directly pulled out from the thread gap when the second conductive wire 4 is pulled. In addition, since the limiting portion 10 is disposed in the accommodating portion 7, the conductive section 11 is extended from the accommodating portion 7 to the thread gap at an angle which is nearly 90°. Therefore, the frictional force between the conductive section 11 and the edge of accommodating portion 7 is greatly enhanced, and thus it is further ensured that the limiting portion 10 is firmly fixed in the accommodating portion 7.

Since the conductive section 11 may comprise a plurality of conductive fibers, they are likely to be bifurcated during use, which greatly reduces the friction force between the conductive section 11 and the first and second threaded sections 8, 5, which would further weaken the disposition of the conductive section 11 in the thread gap. Therefore, the lamp cap 1 of the present disclosure can greatly enhance the stable arrangement of the conductive section 11 in the thread gap by the above technical solution, which can greatly enhance the stability of the lamp socket and avoid the occurrence of safety hazards.

Figure 2:
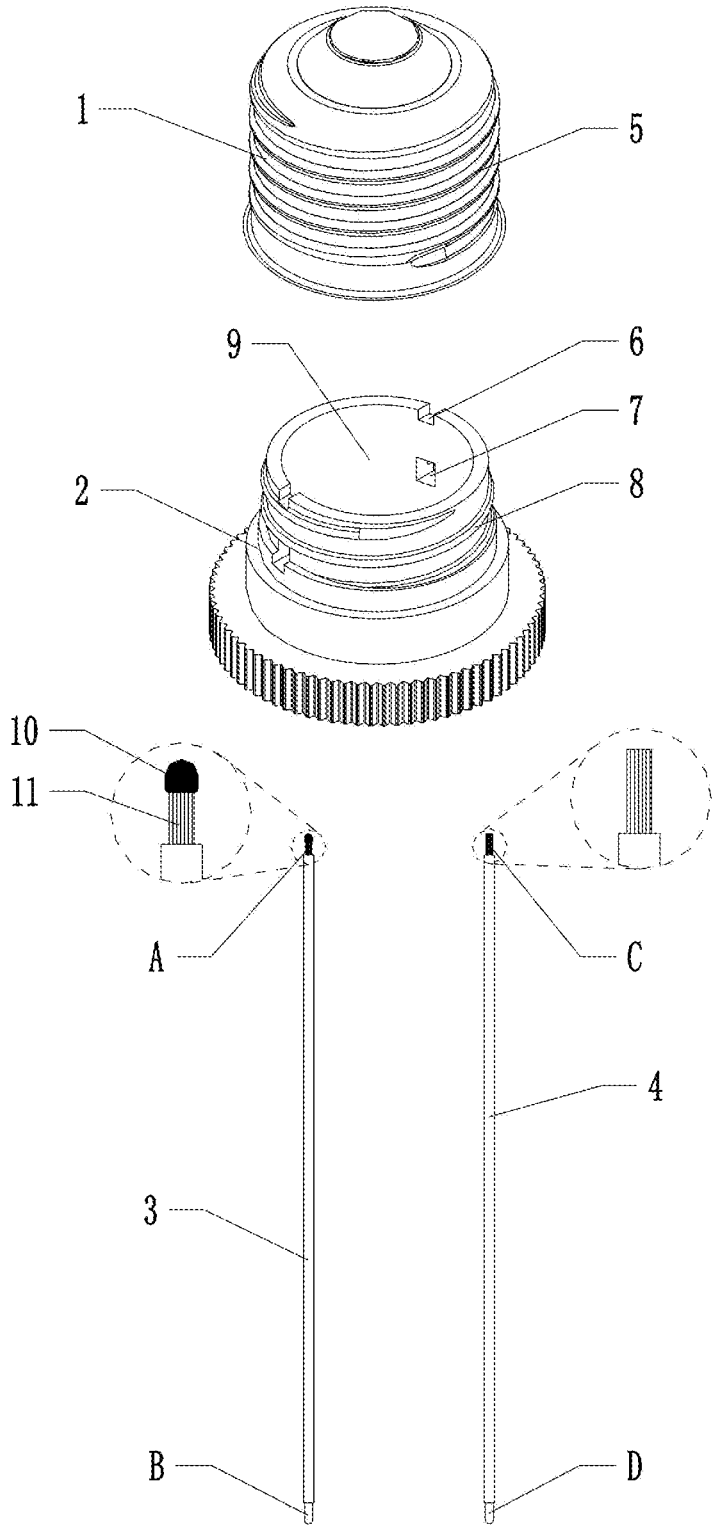
FIG. 2 is an exploded view of a lamp socket according to an embodiment of the present disclosure.
Figure 5:
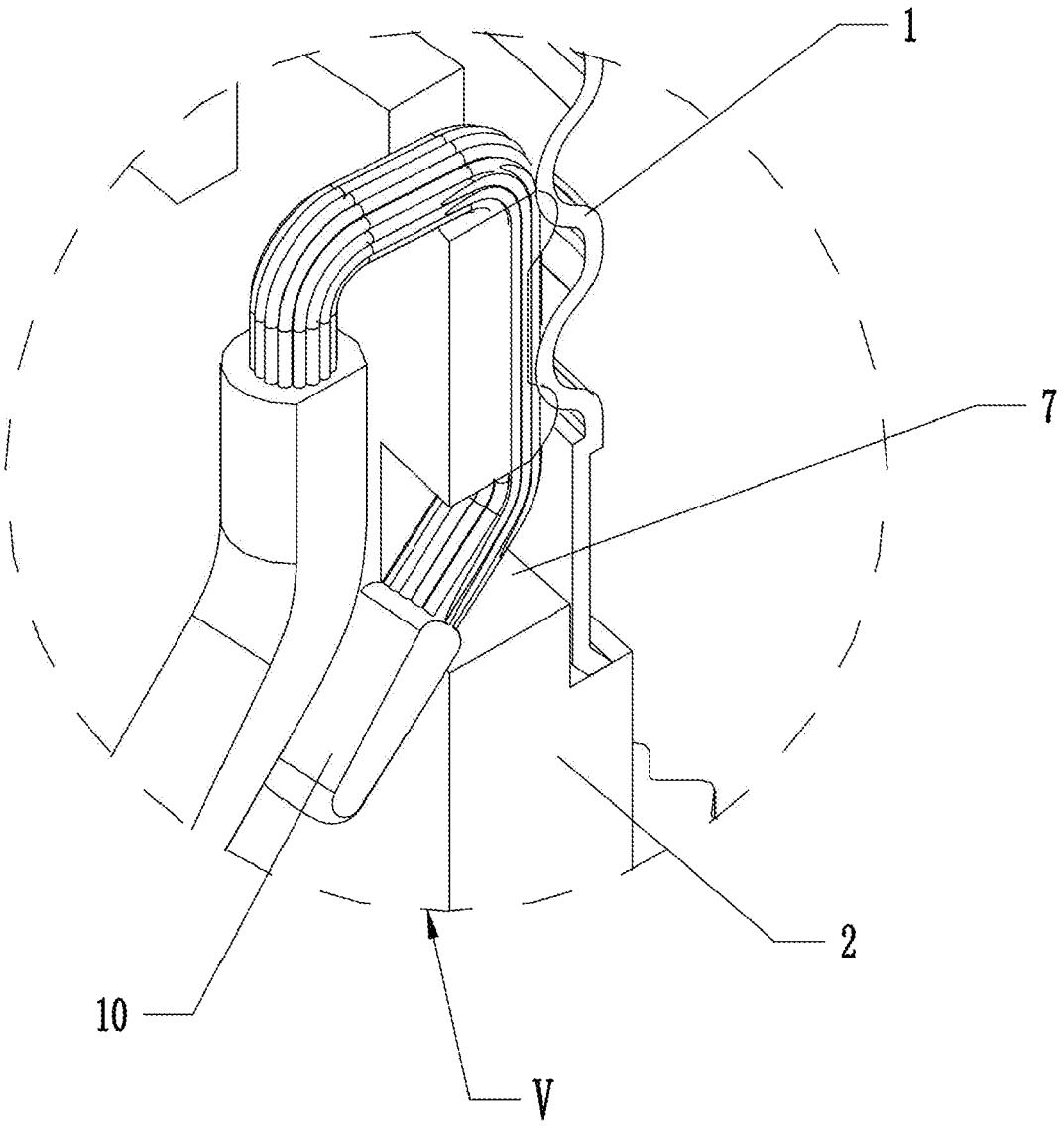
FIG. 5 is a partial enlarged view of circle V shown in FIG. 4.

As shown in FIG. 2 and FIG. 5, in the present embodiment, the accommodating portion 7 is a first through hole that penetrates the first threaded section 8 and communicates with the first passage 9. Specifically, during the assembly process, the second conductive wire 4 first passes through the first passage 9 of the connecting seat 2 and is bent outward, the conductive section 11 is allowed to pass through the thread gap, and finally the limiting portion 10 is allowed to pass through or be located in the first passage 9. In another embodiment, the accommodating portion 7 is a blind hole provided in the threaded section, and the limiting portion 10 is finally located at the accommodating portion 7.

As shown in FIG. 2, in the present embodiment, the limiting portion 10 is a bulk conductor or a spherical conductor provided on the conductive section 11. Specifically, in the embodiment, the limiting portion 10 is an electrical conductor at the end of the conductive section 11 formed by a tin soldering process. Since the conductive section 11 is generally composed of a plurality of conductive fibers, the limiting portion 10 functions to cooperate with the accommodating portion 7 to firmly connect the conductive section 11 to the thread gap, and also to cure the conductive fibers to allow the ends of the conductive fibers to be solidified together to enhance the reliability of the cooperation between the limiting portion 10 and the accommodating portion 7. In another embodiment, the limiting portion 10 can be other electrical conductors fixed at the end of the conductive section 11.

As shown in FIG. 2, in the present embodiment, the first conductive wire 3 has an A terminal and a B terminal, and the second conductive wire 4 has a C terminal and a D terminal. The B terminal and the D terminal are each attached with a tin layer by tin immersion, which is convenient for the male connector (not shown), and will not be described herein. The C terminal is directly electrically connected to the first conductive region 12 of the lamp cap 1, and the A terminal has a limiting portion 10 formed thereon, which will not be described herein.

As shown in FIG. 2 and FIG. 4, in the present embodiment, the upper edge of the connecting seat 2 is provided with a first groove 6 adapted to the second conductive wire 4, and the first groove 6 is used for limiting the second conductive wire 4. Specifically, the second conductive wire 4 can pass through the first groove 6 when passing through the first passage 9 and can be bent outwardly. The first groove 6 can function to limit the second conductive wire 4 to ensure that the conductive section does not move much with respect to the connecting seat under the movement of the lamp cap 1 when the lamp cap 1 rotates relative to the connecting seat 2, ensuring normal use of the lamp socket.

The above description is merely some specific embodiments of the present disclosure. However, the protection scope of the disclosure invention is not limited thereto. Any variation or substitution derived from the present disclosure without creative efforts falls within the protection scope of the present disclosure.

What is claimed is:

1. A lamp socket, comprising:

a connecting seat having a first passage provided therein, the connecting seat having a first threaded section for thread connection with a lamp and an accommodating portion provided in the first threaded section;

a lamp cap detachably disposed at the connecting seat, the lamp cap having a first conductive region and a second conductive region, the second conductive region having a second threaded section adapted to the first threaded section, a thread gap being formed between the first threaded section and the second threaded section;

a first conductive wire passing through the first passage and electrically connected to the first conductive region; and a second conductive wire having an end with a conductive section, the conductive section having a limiting portion having a radial dimension greater than the thread gap;

wherein the second conductive wire passes through the first passage, the conductive section passes through the thread gap, and the limiting portion is disposed in the accommodating portion.

2. The lamp socket according to claim 1, wherein the accommodating portion is a first through hole that penetrates the first threaded section and communicates with the first passage.

3. The lamp socket according to claim 1, wherein the accommodating portion is a blind hole provided in the threaded section.

4. The lamp socket according to claim 1, wherein the limiting portion is a bulk conductor or a spherical conductor on the conductive section.

5. The lamp socket according to claim 1, wherein the limiting portion is made of tin.

6. The lamp socket according to claim 1, wherein an upper edge of the connecting seat has a first groove adapted to the second conductive wire for limiting the second conductive wire.

7. The lamp socket according to claim 1, wherein the first conductive wire is a positive wire and the second conductive wire is a negative wire.

8. The lamp socket according to claim 4, wherein the limiting portion is made of tin.

* * * * *